United States Patent [19]

Gilhooly

[11] 4,213,214

[45] Jul. 22, 1980

[54] MULTIPLE FIRMNESS MULTIPLE SLEEPER MATTRESS

[76] Inventor: James E. Gilhooly, 31550 Agoura Rd., Apt. 5, Westlake Village, Calif. 91361

[21] Appl. No.: 972,927

[22] Filed: Dec. 26, 1978

[51] Int. Cl.[2] ..... A47C 27/15; A47C 23/00

[52] U.S. Cl. ..... 5/464; 5/481

[58] Field of Search ..... 5/345 R, 91, 355, 352, 5/357, 370, 329, 351, 464, 448

[56] References Cited

U.S. PATENT DOCUMENTS

| | | | |
|---|---|---|---|
| 2,651,788 | 9/1953 | Forwood | 5/352 |
| 3,166,768 | 1/1965 | Cunningham | 5/351 |
| 3,210,781 | 10/1965 | Pollock | 5/351 |
| 3,274,625 | 9/1966 | Metzger | 5/345 R |
| 3,702,484 | 11/1972 | Tobinick et al. | 5/370 |

FOREIGN PATENT DOCUMENTS

| | | | |
|---|---|---|---|
| 1258752 | 12/1971 | United Kingdom | 5/352 |

*Primary Examiner*—Roy D. Frazier

*Assistant Examiner*—Alexander Grosz

*Attorney, Agent, or Firm*—John J. Posta, Jr.

[57] ABSTRACT

The improved mattress of the present invention is adapted to sleep two or more people in side by side relation, each person being supported on resilient means defining a separate area of preselected firmness, the two areas being deposed lengthwise of the mattress in essentially parallel relation and being of different firmnesses. The mattress also includes resilient means defining an intermediate area between and integrally connecting the first two areas, and also disposed lengthwise of the mattress and having a graduated range of firmnesses from that of the first area to that of the second area. The resilient means may comprise elastomeric foam layers and/or sets of springs, and a detachable fluid-filled layer may be deposed thereover for improved comfort. The mattress is inexpensive and durable and offers individualized support and improved comfort for both sleepers without any sharp uncomfortable line of demarcation between the areas of differing firmness.

11 Claims, 7 Drawing Figures

MULTIPLE FIRMNESS MULTIPLE SLEEPER MATTRESS

BACKGROUND OF THE INVENTION

1. Field of the Invention

The present invention generally relates to mattresses and more particularly to multiple firmness multiple sleeper mattresses of an improved type.

2. Prior Art

Most sleeper mattresses for beds, sofa beds and the like provide only a single firmness of support. When they are occupied by two persons who have different firmness preferences or requirements, one of such occupants may experience insomnia, discomfort, etc. Accordingly, there is a need to provide a multiple sleeper mattress which is specifically adapted to the firmness, desires, needs and requirements of both occupants without providing any discomfort.

Although certain types of multiple occupant mattresses provide variable firmness, none are constructed to fully satisfy both sleepers. Thus, U.S. Pat. No. 3,739,409, for example, discloses a mattress which is capable of being changed in firmness overall, but not in selected areas. U.S. Pat. No. 3,110,042 discloses a mattress formed of two vertically stacked plies, one firmand the other soft. The firmness is selected by determining which ply will be on top. Both sleepers would be subjected to essentially the same firmness. U.S. Pat. Nos. 3,626,523, 3,534,417, 3,126,554 and 3,551,924 disclose orthopedic mattresses which are constructed to vary in firmness longitudinally, that is, from head to toe, but not transversely. Accordingly, they would subject both sleepers to the same set of firmnesses. U.S. Pat. No. 2,945,244 discloses a mattress with a rim having one degree of firmness, and the remainder of which mattress can be regulated to provide a desired simple degree of firmness throughout. U.S. Pat. No. 3,274,625 discloses a mattress having two side by side zones of differing firmness, one quilted, the other not. However, if a sleeper were to bridge these zones he or she would experience discomfort due to the disparity in firmness of these two zones. Thus, there is still a need for a simple, inexpensive, multiple firmness multiple sleeper mattress having approved sleeping comfort for both sleepers simultaneously.

SUMMARY OF THE INVENTION

The improved multiple firmness multiple sleeper mattress of the present invention satisfies all of the foregoing needs. The mattress is substantially as set forth in the Abstract above. Thus, it includes two separate sleeping areas, one for each sleeper, which areas differ in firmness. Moreover, it provides an intermediate bridging area between the first two areas, which intermediate area has a series of firmnesses which smoothly graduate between those of the first two areas, and blend therewith so that an occupant bridging the intermediate area and either the first or second sleeping area will neither experience discomfort nor insomnia, nor even notice any major change in firmness.

The resilient means providing the desired firmness in the three described areas can be of the foam layer type, or sets of springs or the like, and an optional removable fluid-filled top layer can also be provided to increase comfort and further smooth the firmness gradations. The mattress is simple, inexpensive and uniquely adapted to provide comfort for two sleepers having differing desires and/or needs regarding mattress firmness. Further features of the invention are set forth in the following detailed description and accompanying drawings.

DRAWINGS

DETAILED DESCRIPTION

Figure 1:
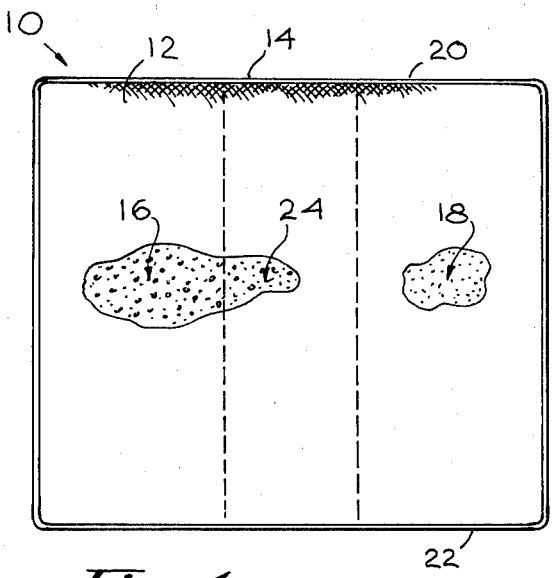
FIG. 1 is a schematic top plan view, partly broken away, of a first preferred embodiment of the improved multiple firm, multiple sleeper mattress of the present invention.
Figure 2:
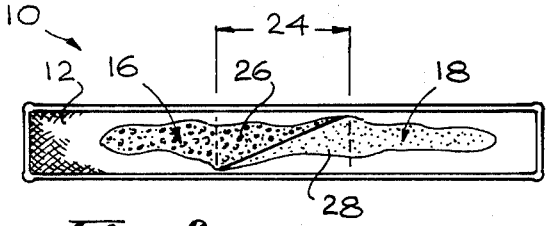
FIG. 2 is a schematic front elevation, partly broken away, of the mattress of FIG. 1.

FIGS. 1 and 2

Now referring more particularly to FIG. 1 of the accompanying drawings, a first preferred embodiment of the improved multiple firmness, multiple sleeper mattress of the present invention is schematically depicted in top plan view. Thus, mattress 10 is shown. Mattress 10 is generally square or rectangular in top plan view and of any desired thickness. It comprises an outer cover 12 of cloth or the like, seamed at the periphery 14 thereof and fully enclosing resilient means in the form of first and second layers 16 and 16, respectively, of foam polyurethane elastomer or the like. Thus, layers 16 and 18 could be of natural or synthetic rubber or other suitable resilient material. Layer 16 has a different firmness than layer 18. Layers 16 and 18 each extend substantially the entire length of mattress 10, that is, from head 20 to toe 22, and are disposed in side by side relation. Each of layers 16 and 18 is of sufficient width to fully support a sleeper. Thus, mattress 10 is at least double bed in size.

Moreover, layers 16 and 18 overlap each other on one side thereof to provide an intermediate layer 24 therebetween. Layer 24 is integral with layers 16 and 18. Intermediate layer 24 is smoothly graduated in firmness across the width thereof, so that its area nearest layer 16 closely matches layer 16 in firmness, while its area nearest layer 18 closely matches layer 18 in firmness. This is most easily accomplished, as shown in FIG. 2, by having side portion 26 of layer 16 slope up, exactly matching the downward slope of side portion 28 of layer 18. It will be understood that, if desired, portion 26 could slope down and portion 28 could slope up to exactly match portion 26. In any event, portions 26 and 28 are sealed together so that layers 16, 18 and 24 are a unitary structure. Intermediate layer 24 need not be of as great a width as layers 16 and 18 while still providing the desired firmness gradations for maximum comfort. Thus, mattress 10 is uniquely suited to provide individualized sleeping comfort for two people at low cost.

Moreover, it is durable, efficient and can be made in a variety of firmness combinations.

FIG. 4

Figure 4:
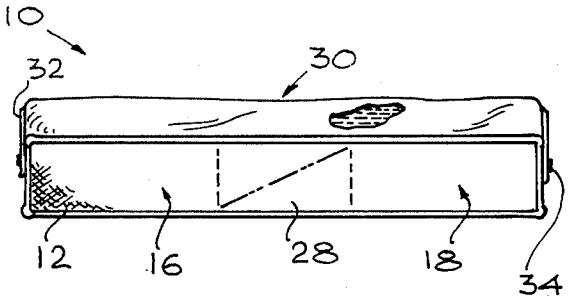
FIG. 4 is a schematic front elevation partly broken away of the mattress of FIG. 1, with a removable fluid-filled top layer in place thereon.

Further improvements in comfort can also be made by releasably disposing on the upper surface of cover 12, as shown in FIG. 4, a relatively thin, for example 2 inch thick, flexible fluid-filled container 30 of rubberized cloth or the like. Container 30 is of the same shape and size (except thickness) as mattress 10 and may contain water or a lighter fluid, such as air, therein. Container 30 is held in place on mattress 10 by a plurality of depending size straps 32 or the like secured thereto and releasably secured, as by snaps 34, or the like to cover 12. Container 30 forms a top layer which has the effect of further smoothing out the differences in firmness of mattress 10 across its width.

FIG. 3

Figure 3:
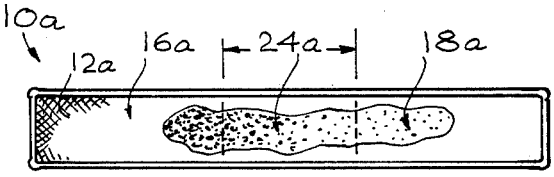
FIG. 3 is a schematic front elevation, partly broken away of a second preferred embodiment of the improved mattress of the present invention.

A second preferred embodiment of the improved mattress of the present invention is schematically depicted in FIG. 3 of the drawings. Thus, mattress 10*a* is shown which is substantially identical to mattress 10 in most respects. Thus, components of mattress 10*a* are similar to those of mattress 10 and bear the same numerals but are succeeded by the letter "a". Mattress 10*a* includes integral layers 16*a*, 18*a* and 24*a* disposed within cover 12*a*. However, intermediate layer 24*a* is not formed from portions similar to portions 26 and 28, but instead has a graded series of firmness across its width as a result of, for example, the casting process by which it was made from polyurethane foam or the like. In all other respects, including its range of firmnesses, it is substantially the same as layer 24. Thus, mattress 10*a* has substantially the same advantages as mattress 10.

Figure 5:
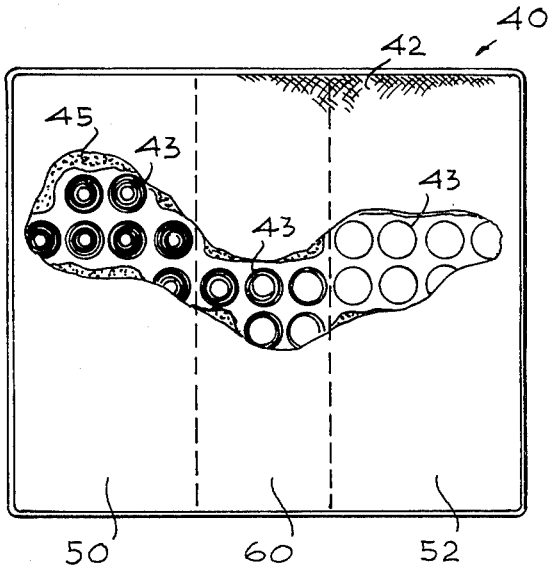
FIG. 5 is a schematic top plan view, partly broken away, of a third preferred embodiment of the improved mattress of the present invention.
Figure 6:
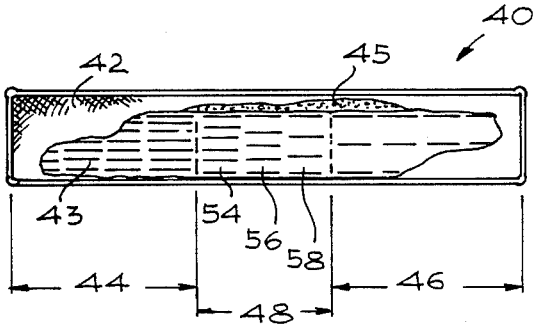
FIG. 6 is a schematic front elevation, partly broken away, of the mattress of FIG. 5; and, FIG. 7 is a schematic front elevation, partly broken away, of the mattress of FIG. 5 with a removable fluid-filled top layer in place thereon.
Figure 7:
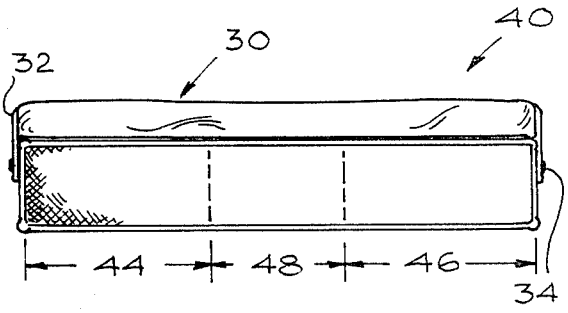

FIGS. 5, 6 and 7

A third preferred embodiment of the improved mattress of the present invention is schematically depicted in FIG. 5 of the drawings. Thus, mattress 40 is shown therein and comprises a generally rectangular cover 42 of cloth or the like, wholly enclosing three separate layers or sets of springs 43. Each spring set extends along the full length of mattress 40. If desired, a cushion 45 of rubber or cloth padding or the like may be interposed between the top of springs 43 and top of cover 42, that is, within cover 42.

A first set 44 of springs 43 and a second set 46 of springs 43 are disposed in parallel side by side relation, separated by an intermediate set 48 of springs 43. All three sets are joined together to provide an integrated unit. The springs 43 of all three sets are disposed in rows and may be the usual type of coil springs for mattresses. Springs 43 of set 44 are all of the same resiliency so that the area 50 of mattress 40 directly overlying the same if of uniform firmness. Springs 43 of set 46 are also all of the same resiliency so that the area 52 of mattress 40 directly overlying them is also of uniform firmness. However, that firmness is substantially less than the firmness of area 50.

Set 48 of coils is divided into parallel sub-sets 54, 56 and 58 of coils across the width of set 48. Sub-set 54 approximates set 44 in resiliency, while sub-set 58 approximates set 46 in resiliency and sub-set 56 is intermediate therebetween in resiliency. Thus, area 60 directly overlying set 48 has a graduated firmness approximating that of area 50 on the side nearest thereto, approximating that of area 52 on the side nearest thereto and intermediate thereto above sub-set 56. Mattress 40 is therefore similar in function and advantages to mattress 10.

In FIG. 7, fluid-filled container 30 which is also shown in FIG. 5, is depicted releasably mounted on the top of mattress 40 and held in place thereon via straps 32 and snaps 34 to provide the desired improved comfort and amoothing out of the firmness differences between areas 50 and 52.

Various other modifications, changes, alterations and additions can be made in the improved mattress of the present invention, its components and their parameters. All such modifications, changes, alterations and additions as are within the scope of the appended claims form part of the present invention.

What is claimed is:

1. An improved multiple firmness, multiple sleeper mattress, said mattress comprising integral resilient means defining three separate areas of different firmness extending along the width of said mattress, each of said separate areas being in a side-by-side relationship with each area extending the full length of said mattress, including:

(a) First means, defining a first area extending along the entire length of the left side of said mattress which has a substantially constant first firmness and which is adapted to support a first sleeper, (b) Second means defining a second area extending along the entire length of the right side of said mattress which has a substantially constant second firmness which is different from said first firmness, and which as adapted to support a second sleeper, (c) Said second means extending generally parallel to said first means, and (d) Third means, defining an intermediate area extending along the entire length of the mid-portion of said mattress and disposed between and integrally connected to both said first and second means, (e) Said intermediate area having a constantly varying firmness extending across its width, with the firmness of the third means adjacent to the first means approximating the firmness of said first means and the firmness of the third means adjacent to the second means approximating the firmness of the second means.

2. The improved mattress of claim 1 wherein said first, second and third means comprise elastomeric foam layers.

3. The improved mattress of claim 2 wherein said first and second foam layers intercept each other in said intermediate area to form said third foam layer.

4. The improved mattress of claim 3 wherein said first and second foam layers each include a sloped lateral portion, said two sloped lateral portions overlying each other to form said third foam layer.

5. The improved mattress of claim 2 wherein said mattress includes a fluid-containing layer overlying said foam layers.

6. The improved mattress of claim 1 wherein each of said first, second and third means comprises a separate set of springs.

7. The improved mattress of claim 6 wherein said third set of springs includes a first sub-set of springs adjacent to and of a firmness similar to said first set of springs, a second sub-set of springs adjacent to and of a firmness similar to said second set of springs, and at least one additional sub-set of springs of firmness between that of said first sub-set and that of said second sub-set.

8. The improved mattress of claim 6 wherein said mattress includes a fluid-containing layer overlying said springs.

9. The improved mattress of claim 1 wherein said resilient means also include a fluid-containing layer overlying said first, second and intermediate areas.

10. The improved mattress of claim 9 wherein said fluid-containing layer is detachable from the remainder of said mattress.

11. The improved mattress of claim 1 wherein said intermediate area is narrower than said first and second areas.

* * * * *